US009822538B2

(12) United States Patent
Taylor

(10) Patent No.: US 9,822,538 B2
(45) Date of Patent: Nov. 21, 2017

(54) PLATFORM SYSTEM

(71) Applicant: ISCHEBECK TITAN LIMITED, Burton upon Trent, Staffordshire (GB)

(72) Inventor: Mark Taylor, Burton upon Trent (GB)

(73) Assignee: ISCHEBECK TITAN LIMITED, Burton Upon Trent, Staffordshire (GB)

( * ) Notice: Subject to any disclaimer, the term of this patent is extended or adjusted under 35 U.S.C. 154(b) by 0 days.

(21) Appl. No.: 15/148,133

(22) Filed: May 6, 2016

(65) Prior Publication Data

US 2016/0326756 A1 Nov. 10, 2016

(51) Int. Cl.

| | |
|---|---|
| ***E04G 21/32*** | (2006.01) |
| ***E04G 1/15*** | (2006.01) |
| ***E04G 5/08*** | (2006.01) |
| ***E04G 3/24*** | (2006.01) |
| *E04G 3/28* | (2006.01) |

(52) U.S. Cl.

CPC ..... *E04G 21/3266* (2013.01); *E04G 1/15* (2013.01); *E04G 1/152* (2013.01); *E04G 3/24* (2013.01); *E04G 5/08* (2013.01); *E04G 21/3204* (2013.01); *E04G 21/3223* (2013.01); *E04G 21/3247* (2013.01); *E04G 2001/157* (2013.01); *E04G 2003/286* (2013.01)

(58) Field of Classification Search

CPC ..... E04G 21/3266; E04G 21/3247; E04G 21/3204; E04G 21/3223; E04G 5/08; E04G 1/15

USPC ..... 182/82, 223

See application file for complete search history.

(56) References Cited

U.S. PATENT DOCUMENTS

| | | | | |
|---|---|---|---|---|
| 3,488,898 | A * | 1/1970 | Scaggs | E04H 3/123 182/132 |
| 3,608,251 | A * | 9/1971 | Scaggs | E04H 3/123 52/9 |
| 6,539,672 | B1 * | 4/2003 | Frost | E04H 3/123 292/130 |
| 8,407,943 | B2 * | 4/2013 | Sudkamp | B66F 7/0658 182/223 |
| 2008/0302605 | A1 * | 12/2008 | St-Germain | E04G 1/20 182/223 |
| 2013/0168626 | A1 * | 7/2013 | Blinn | E04G 21/3266 256/31 |

(Continued)

FOREIGN PATENT DOCUMENTS

| | | |
|---|---|---|
| GB | 2481398 A | 12/2011 |
| GB | 2489667 A | 8/2014 |
| GB | 2510881 A | 8/2014 |

*Primary Examiner* — Katherine Mitchell
*Assistant Examiner* — Marcus Menezes
(74) *Attorney, Agent, or Firm* — Andrew W. Chu; Craft Chu PLLC

(57) ABSTRACT

A platform system includes a support structure of variable length; a platform mountable on the support structure; and a plurality of platform supports for supporting the platform. At least one of the platform supports is slideably mounted on the support structure such that it is slideable with respect to the support structure. At least one of the platform supports includes a spacing element, which extends between that platform support and an adjacent one of the platform supports and engages the adjacent platform support, such that the maximum spacing between those platform supports is limited by the spacing element.

18 Claims, 6 Drawing Sheets

(56) References Cited

U.S. PATENT DOCUMENTS

2014/0339018 A1* 11/2014 Blinn ..... E04G 21/3266
182/82

* cited by examiner

Fig. 7a
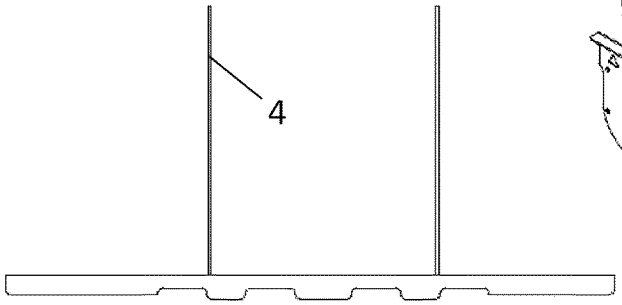
Fig. 7b
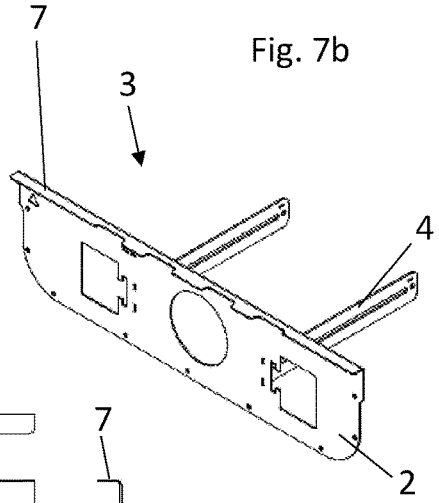
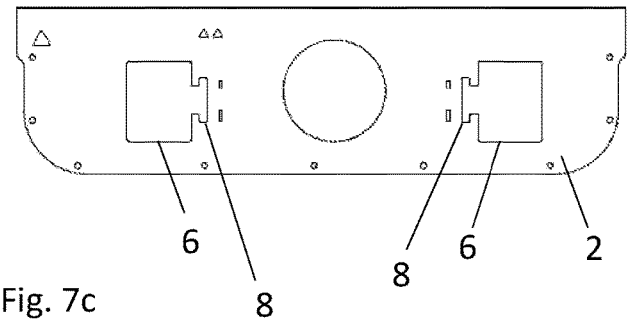
Fig. 7c
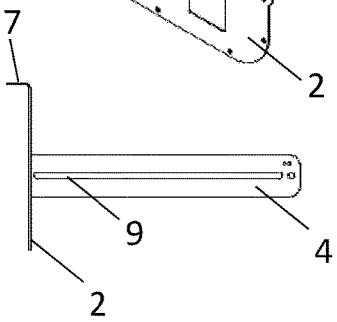
Fig. 7d

PLATFORM SYSTEM

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present disclosure relates to a platform system, in particular to a platform system suitable for use with a climbing screen; and to a climbing screen comprising the platform system.

2. Description of Related Art Including Information Disclosed Under 37 CFR 1.97 and 37 CFR 1.98.

In modern construction, particularly in the construction of high rise buildings it is common to have a central core, which houses lift shafts and stairs and which provides support to the floors of the construction, wherein the central core and floors are formed by poured concrete. Such structures commonly have no external walls. During large periods of construction therefore, the floors remain open at their edges. It is only when a façade is introduced that the perimeter of the building is enclosed. Such open floors cause numerous health and safety risks. Workers operating on the exposed floors of the construction are at risk of falling from the construction. Workers or members of the public on the ground are at risk from tools, equipment or debris falling from the exposed floors.

It is known to provide safety screens, which extend around at least a portion of the perimeter of constructions, which effectively provide a temporary façade. These safety screens are advantageously moveable vertically to protect the perimeter of any required floor as the construction progresses. Such screens are commonly referred to as "climbing screens". Movement of the climbing screens up the construction may be effected either by crane or by hydraulic lifting equipment located on floors of the construction.

These climbing screens typically comprise a climbing rail and a safety screen. The climbing rail is engaged, in use, by floor guides, which project outwardly from the edges of the floors. The floor guides allow translation of the climbing screen along the construction and are further operable to lock the position of the climbing screen adjacent appropriate floors during use.

Typically, climbing screens have been of a fixed width, which has not been a problem in the construction of conventional high rise buildings. There is, however, a recent trend for high rise buildings of unconventional form, wherein the cross-section of the building varies through its height. There would be a great advantage to provide a climbing screen with platforms that could have their lengths altered easily and safely whilst the climbing screen was mounted to the building, to allow for adaption to the building as the climbing screen rises.

Prior art platform systems have been proposed which feature mechanisms for allowing their extension/retraction in use, however, these have suffered from drawbacks.

BRIEF SUMMARY OF THE INVENTION

The present invention arose in a bid to provide an improved platform system, suitable for use with a climbing screen, which allows for simple and safe extension when the climbing screen is mounted to a construction, which is lightweight and which is compact when retracted.

According to the present invention in a first aspect, there is provided a platform system comprising: a support structure of variable length; a platform mountable on the support structure; and a plurality of platform supports for supporting the platform, wherein at least one of the platform supports is slideably mounted on the support structure such that it is slideable with respect to the support structure, and at least one of the platform supports comprises a spacing element, which extends between that platform support and an adjacent one of the platform supports and engages the adjacent platform support, such that the maximum spacing between those platform supports is limited by the spacing element.

Further, preferred, features of the platform system are defined in the dependent claims.

According to the present invention in a further aspect, there is provided a climbing screen comprising a platform system as defined above.

BRIEF DESCRIPTION OF THE SEVERAL VIEWS OF THE DRAWINGS

Non-limiting embodiments will now be described, by way of example only, with reference to the accompanying drawings.

FIGS. 7*a*, 7*b*, 7*c* and 7*d* show a platform support of the second support in plan, perspective, front and side views, respectively.

DETAILED DESCRIPTION OF THE INVENTION

Figure 1:
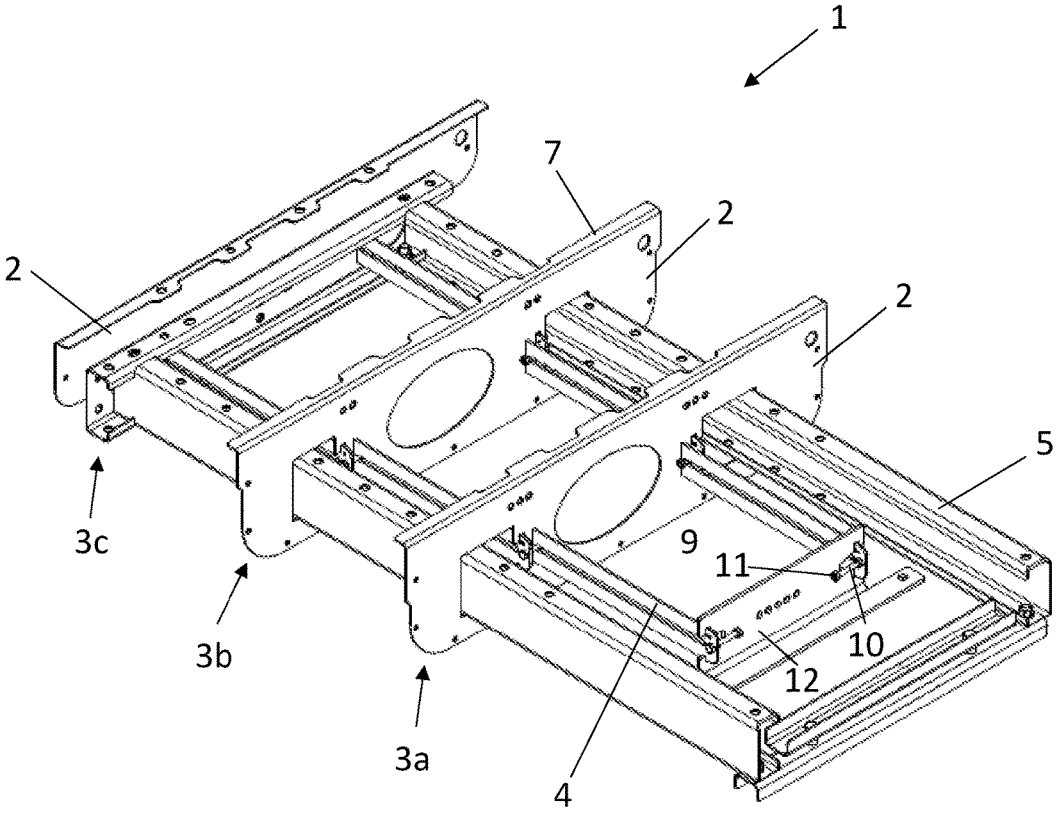
FIG. 1 shows a perspective view of a second support of a support structure of a platform system, according to an embodiment of the present invention, in an extended state.

A second support 1 of a support structure 102 of a platform system 100 for use with a climbing screen 104 is shown in FIGS. 1 to 6 and FIG. 8. The support structure 102 of the platform system 100 further comprises a first support 101. The first support 101 is rigidly connected to a climbing screen 104 that is adapted to be attached to a building during construction. The second support 1 is arranged to be cantilevered by the first support. The second support may be connected to the first support by any suitable connection means that allow for the second support to slide relative to the first support, wherein by translation of the first and second supports relative to one another, the length of the support structure is adjustable. As will be appreciated, the support structure may have its length varied by any desired amount up to a maximum extension length. An exemplary climbing screen to which the platform system may be connected is presented in GB 2510881.

Figure 8:
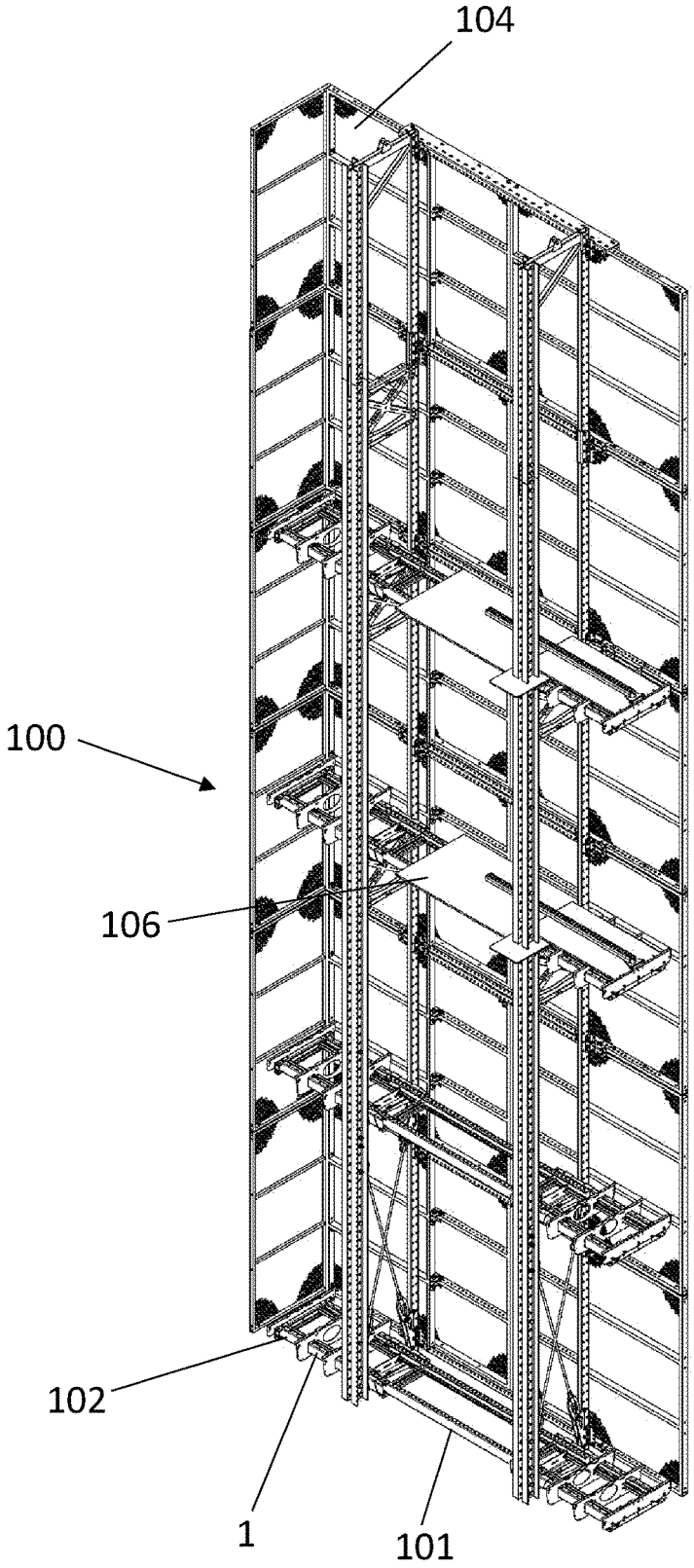
FIG. 8 is a schematic view of an embodiment of the platform system, according to the present invention.

A platform 106 in FIG. 8 will be mounted on the support structure, for supporting workers and equipment. Any conventional platform structure may be used. The platform may be formed from one or more suitably sized/shaped plywood sheets, or similar.

The second support 1 will now be considered in detail.

The second support 1 comprises a plurality of platform supports 3 for supporting the platform. The platform may be supported directly or indirectly by upper surfaces of the platform supports 3. In the present arrangement there are three platform supports 3*a*, 3*b* and 3*c*. It should be appreciated, however, that more or less platform supports may be provided. At least one of the platform supports 3 is slideably mounted on the support structure such that it is slideable with respect to the support structure. In the present arrangement there are two slidably mounted platform supports 3*a*, 3*b* provided. Further slideable platform supports may be provided as desired.

The platform support 3*c*, which is the furthest platform support from the first support, is secured to the distal end of the second support. In FIG. 1, a plate-like bracket 2 of the platform support 3*c* is shown spaced from the remainder of the platform support 3*c* for illustrative purposes only.

Figure 4:
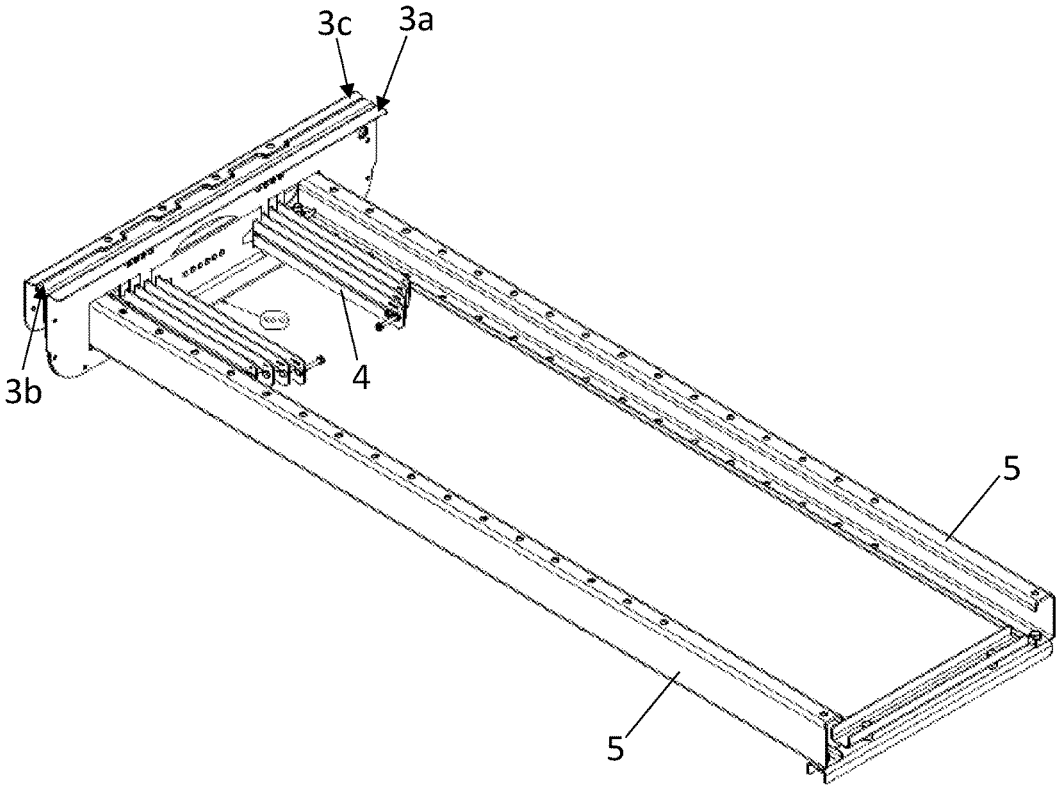
FIG. 4 shows a perspective view of the second support in a retracted state.
Figure 5:
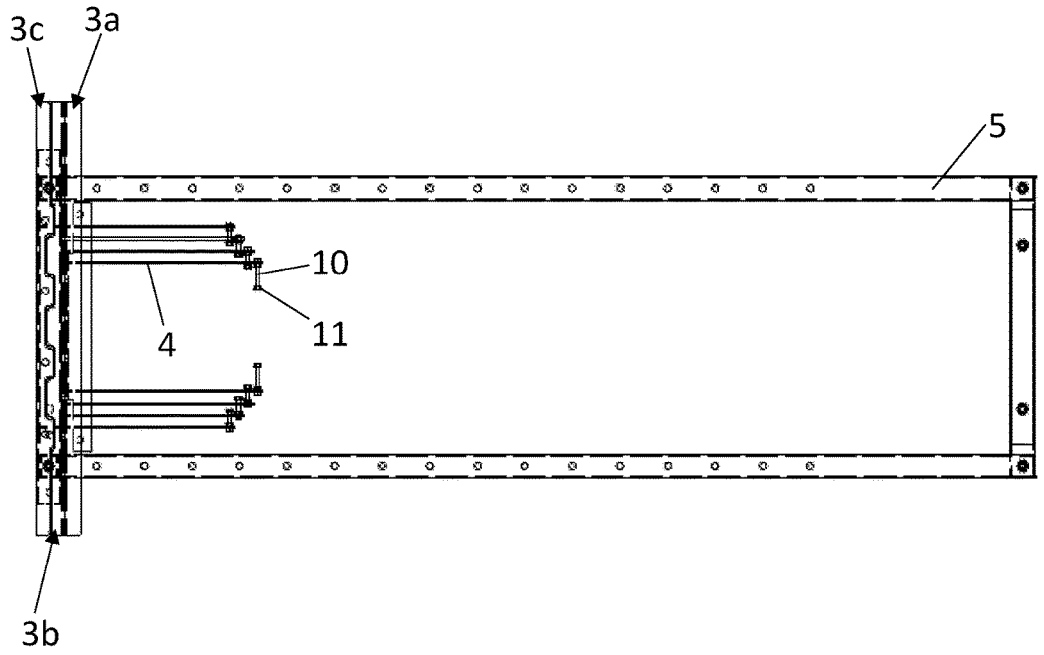
FIG. 5 shows a top plan view of the second support in the retracted state.
Figure 6:
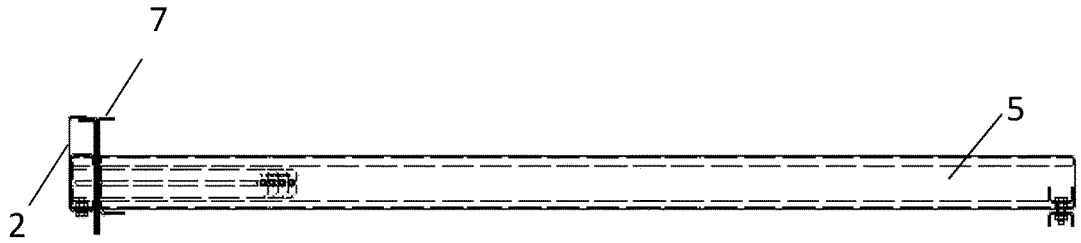
FIG. 6 shows a partial sectional side view of the second support in the retracted state.

The platform supports 3*a*, 3*b* are slideably mounted on the second support 1. The second support 1 comprises a pair of support arms 5. The support arms extend parallel to one another in the sliding/extension direction of the platform system. Each of the slideably mounted platform supports 3*a*, 3*b* comprises a bracket 2 that is provided with suitable apertures 6 (seen most clearly in FIGS. 7*b* and 7*c*) for receiving the support arms 5 therethrough, as shown. With this arrangement, the platform supports 3*a*, 3*b* may slide relative to the support arms 5, and thereby relative to the support structure as a whole. The brackets 2 preferably comprise plates, as shown, which are moreover preferably substantially flat. With the brackets 2 comprising plates they have a have a low profile and are lightweight whilst at the same time offering suitable strength in the vertical direction for supporting the platform in use. With the platform system in a retracted state, the platform supports may be nested together (as seen in FIGS. 4 to 6). The upper portions of the plates may be bent at 90 degrees to provide horizontal support surfaces 7, against which the platform may rest in use. Of course, the horizontal support surfaces may be provided in a different manner, particularly if the brackets 2 do not comprise plates. The platform may be fixed to the horizontal support surfaces using bolts, screws or other fixing means. There may be suitable openings provided in the horizontal support surfaces for receipt of such fixings or self-tapping fixings may be used in which case openings may not be required.

The connection means for connecting the second support 1 to the first support may comprise a pair of suitable brackets fixed to the first support and arranged to slideably receive the respective support arms 5. Alternatively, a telescopic arrangement could be implemented, with the support arms 5 received within suitable support arms of the first support.

Fundamental to the present invention is the provision of at least one spacing element 4, which extends between a pair of adjacent platform supports 3 to limit the maximum spacing between those platform supports. The adjacent platform supports 3, between which the spacing element 4 extends, are retained captive to one another, including during relative movement between those platform supports 3. In the present arrangement all of the platform supports 3*a*, 3*b*, 3*c* are provided with spacing elements 4 so that the maximum spacing between every pair of adjacent platform supports is limited. Specifically, each of the platform supports 3 is provided with a pair of spacing elements 4, which comprise bars or torsion bars. Each of the torsion bars are fixed at a first end to a respective one of the platform supports with a second end received through a respective aperture 8 provided in the adjacent platform support. The torsion bars are rigid. They may be formed from sheet metal. They may be welded, bolted or otherwise fixed at their first ends to the platform supports. The apertures 8 are preferably profiled to conform closely to the profile of the torsion bars, which substantially prevents any twisting of the torsion bars. A torsion bar arrangement is preferred since the platform supports comprising plate-like brackets may be reliably maintained in a vertical orientation in use, allowing them to be thin without compromising their load bearing ability.

Each of the spacing elements 4 is arranged so that the second end of the spacing element engages with the adjacent platform support and thereby may not be pulled out through the respective aperture 8 when the platform support system is extended, thus retaining adjacent platform supports captive to each other. Such engagement may occur in any manner that achieves the desired result. The second end of the spacing element may directly or indirectly engage any portion of the adjacent platform support. In the present arrangement, the spacing element 4 of each of the platform supports is provided with a longitudinal slot 9 that extends in the sliding direction. The second end of each spacing element 4 is provided with a protrusion 10 for engaging the slot 9 provided in the spacing element of the adjacent platform support. The protrusions are held captive by suitable fixing means 11. In the present arrangement, the protrusions comprise bolts and the fixing means comprise nuts. The second ends could alternatively/additionally be arranged to engage the rear faces of the brackets 2.

Figure 2:
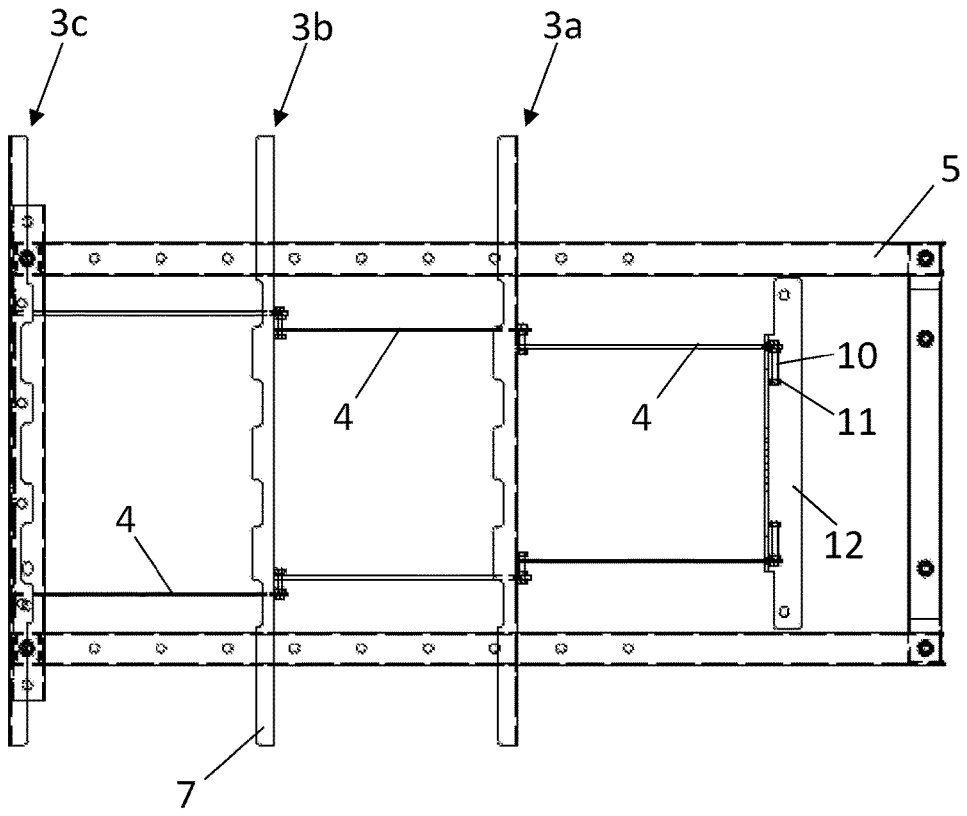
FIG. 2 shows a top plan view of the second support in the extended state.
Figure 3:
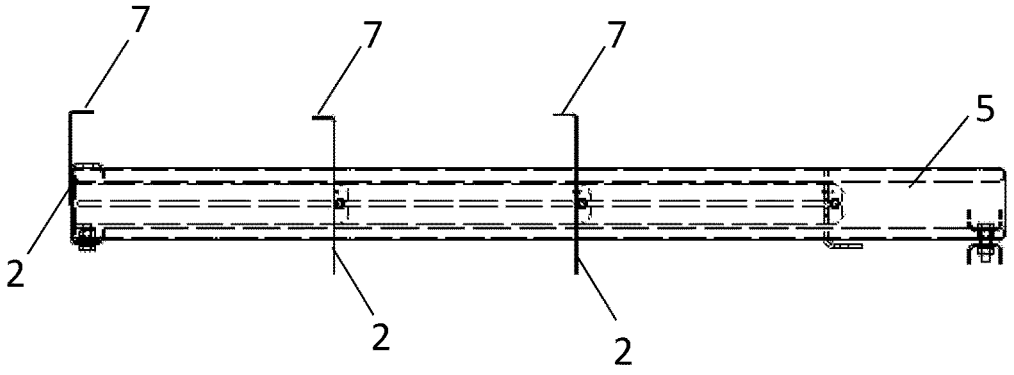
FIG. 3 shows a partial sectional side view of the second support in the extended state.

As seen most clearly in FIGS. 2 and 5, the spacing elements extend parallel to one another in a staggered array. Adjacent spacing elements in the sliding direction are offset from one another in a direction perpendicular to the sliding direction. The offset may be graduated between the innermost and outermost spacing elements in the sliding direction.

There is no platform support provided inwards of the innermost platform support 3*a* (which is the platform support closest to the first support of the support structure) in the sliding direction. To limit sliding movement of the innermost platform support 3*a* there is preferably therefore provided a stop member 12, which is fixed to the first support of the support structure. Whilst the stop member/mechanism may clearly take many forms, as will be readily appreciated by those skilled in the art, in the present arrangement, the stop member 12 comprises a bracket, which is provided with suitable apertures 8 for receiving the second ends of the spacing elements 4 of the platform support 3*a* in the same manner as the apertures 8 provided in the platform supports 3, wherein the protrusions (bolts) 10 on the second ends of the spacing elements 4 of the platform support 3*a* engage the rear face of the bracket 9 to prevent the second ends being pulled through the apertures when the platform system is extended.

The platform may be of unitary form or may comprise a number of separate platform parts that combine to form the platform. In any case, the platform will span both the first and second supports of the support structure to be supported thereby when the platform support is other than in a fully retracted state. The platform supports 3 of the second support will support the platform outwards of the first support in the sliding direction whilst the first support supports the platform over its remaining length, i.e. inwards of the second support in the sliding direction.

The platform system may comprise a second support as described herein slideably attached to each of its opposed ends in the sliding direction.

By virtue of the arrangement as described herein, the maximum spacing between all of the platform supports is controlled along with the maximum extension of the platform support system. Such control is automatic in the sense that all a user must do is pull/push the distal end of the second support 1 to extend/retract the platform support, wherein the interconnection of adjacent platform supports limits the maximum spacing therebetween and limits the maximum extension of the platform support as a whole. It should be appreciated that numerous alternative arrangements will be possible for limiting the maximum spacing between adjacent platform supports, within the scope of the claims that follow. For example, the spacing elements may take various alternative forms, and could include flexible members or otherwise.

Operation of the platform system will now be discussed. Note that in FIGS. 4 to 6, the stop member 12 is omitted.

In the fully retracted state, in accordance with FIGS. 4 to 6, the platform supports 3*a*, 3*b*, 3*c* are nested with one another. The support arms 5 of the second support have been drawn inwards (with respect to the first support of the support structure) as far as possible to minimize the length of the support structure. The platform supports 3*a*, 3*b*, 3*c* lie closely adjacent to one another or in abutment with one another. The bracket 2 of the innermost platform support 3*a* lies closely adjacent to or in abutment with the end of first support.

To extend the support structure, the distal end of the second support 1 of the support structure is pulled outwards (in the sliding direction). The pulling force will cause the support arms 5 to slide relative to the first support. The platform support 3*c*, which is fixed to the distal end of the second support 1 will move with the support arms 5. The spacing elements 4 of the platform support 3*c* will slide through the apertures 8 in the adjacent platform support 3*b* and the protrusions 10 at the second ends of the spacing elements of the platform support 3*c* will travel in the slots 9 in the support arms 4 of the adjacent platform support 3*b*. Once the protrusions 10 at the second ends of the spacing elements 4 of the platform support 3*c* reach the end of the slots 9 and/or engage the rear face of the bracket 2 of the adjacent platform support 3*b* the maximum spacing between the platform support 3*c* and the adjacent platform support 3*b* is reached. Following such engagement, continued pulling on the distal end of the second support 1 will pull the platform support 3*b* outwards (sliding relative to the support arms 5 of the support structure), which will in turn (following engagement of the spacing elements 4 of the platform support 3*b* with the platform support 3*a*, in the manner detailed above) pull the platform support 3*a* outwards. Since the spacing elements 4 of the platform support 3*a* will engage the stop member 12 that is fixed to the first support to limit outward travel of the platform support 3*a*, the maximum extension of the support structure will be limited by the engagement between the platform supports 3*a*, 3*b*, 3*c* and their respective spacing elements, whilst the maximum spacing between adjacent platform supports 3 is also controlled.

A return force on the distal end of the second support 1 to retract the support structure will cause a reverse to the above sequence.

The support structure is entirely self-contained with no loose parts. All of the components detailed herein are interconnected at all times, which prevents the risk of falling debris.

As mentioned, the platform system may be attached to a climbing screen as detailed in GB 2510881. Such a climbing screen comprises a plurality of climbing rails and a safety screen with one or more platforms extending between the climbing rails and the safety screen. One of more of those platforms may be provided by a platform system as described herein. Moreover, the safety screen may be of variable width as described in that document, wherein the platform system and the safety screen may be extended so as to correspond in width to one another, as desired.

I claim:

1. A platform system, comprising:

a support structure of variable length;

a platform mounted on said support structure;

a plurality of platform supports for supporting said platform, wherein at least one platform support is slideably mounted on said support structure, said at least one platform support being in sliding engagement with said support structure; and a spacing element, extending between said at least one platform support and an adjacent platform support, wherein spacing between said at least one platform support and said adjacent platform support is limited by said spacing element, wherein said spacing element is comprised of a first end fixed to said at least one platform support and a second end in sliding engagement with said adjacent platform support, and wherein said spacing element has a profile conforming to a profile of an aperture in said adjacent platform support.

2. The platform system, according to claim 1, wherein said spacing element connects said at least one platform support and said adjacent platform support during relative movement between said at least one platform support and said adjacent platform support.

3. The platform system, according to claim 1, wherein said second end of said spacing element is held captive by said adjacent platform support.

4. The platform system, according to claim 1, wherein said spacing element comprises a bar.

5. The platform system, according to claim 1, wherein said second end of said spacing element is provided with a protrusion, and said spacing element includes a longitudinal slot extending in a sliding direction of said at least one platform support and said adjacent platform support from said platform, and wherein said protrusion is slideably received by said longitudinal slot.

6. The platform system, according to claim 5, further comprising: a fixing element for said protrusion being held captive in said longitudinal slot.

7. The platform system, according to claim 1, wherein said at least one platform support is in sliding engagement with said support structure.

8. The platform system, according to claim 7, wherein said spacing element, said at least one platform support, or said adjacent platform support comprises a bracket having an aperture, wherein said support structure is received through said aperture.

9. The platform system, according to claim 8, wherein said bracket comprises a plate.

10. The platform system, according to claim 1, wherein said platform supports are arranged nested together when said platform supports are in a retracted state.

11. The platform system, according to claim 1, wherein the support structure comprises a first support; and a second support translatably connected to said first support, said support structure having an adjustable length, and wherein said platform supports are mounted on said second support.

12. The platform system, according to claim 11, further comprising: a climbing screen, said first support being rigidly connected to said climbing screen, said second support being cantilevered by said first support.

13. The platform system, according to claim 11, wherein an end platform support of said plurality of platform supports furthest from said first support is secured to a distal end of said second support.

14. The platform system, according to claim 11, wherein said plurality of the platform supports are slideably mounted to said support structure.

15. The platform system, according to claim 11, further comprising: a plurality of spacing elements for each platform support.

16. The platform system, according to claim 15, wherein said spacing elements extend parallel to one another in a staggered array.

17. The platform system, according to claim 11, further comprising: a stop member affixed to a first platform support of said support structure, said stop member being engaged by an end spacing element of a corresponding platform support closest to said first platform support, said corresponding platform support having a corresponding adjacent platform support, said corresponding adjacent platform support having a range of sliding movement according to an engagement of said stop member to said first platform support.

18. A climbing screen, comprising:

a platform system as recited in claim 1.

* * * * *